299-13 SR

9/21/82 OR 4,350,392

United States Patent [19]

Wild

[11] 4,350,392

[45] Sep. 21, 1982

[54] COAL EXTRACTION IN A LONGWALL WORKING

[75] Inventor: Heinz W. Wild, Essen, Fed. Rep. of Germany

[73] Assignee: Ruhr Kohle AG, Fed. Rep. of Germany

[21] Appl. No.: 723,814

[22] Filed: Sep. 16, 1976

[30] Foreign Application Priority Data

Oct. 24, 1975 [DE] Fed. Rep. of Germany ..... 2547712

[51] Int. Cl.[3] ..... E21C 35/20

[52] U.S. Cl. ..... 299/13; 299/16; 299/18

[58] Field of Search ..... 299/16, 13, 21, 22, 299/18, 19, 87; 166/299

[56] References Cited

U.S. PATENT DOCUMENTS

| | | | |
|---|---|---|---|
| 1,241,386 | 9/1917 | Hutton | 102/304 |
| 2,721,067 | 10/1955 | Russell et al. | 299/64 |
| 2,846,205 | 8/1958 | Bucky | 299/13 X |
| 2,892,405 | 6/1959 | Chesnut | 166/299 |
| 3,088,718 | 5/1963 | Lilly | 299/87 |
| 3,445,139 | 5/1969 | Von Hippel | 299/43 |
| 3,964,792 | 6/1976 | Archibald | 299/13 |

*Primary Examiner*—William F. Pate, III

*Attorney, Agent, or Firm*—Wilson, Fraser, Barker & Clemens

[57] ABSTRACT

Coal is extracted in a longwall working with two subsidiary galleries disposed respectively at the ends of the longwall coal-face. The coal is obtained at the longwall face, is loaded and removed with the aid of a continuous conveyor acting as a longwall-heading conveyor which delivers into one of the subsidiary galleries. In order to extract the coal a plurality of long drill-holes, respectively spaced from the coal-face and from each other by a spacing which corresponds to the effective force of an explosive charge provided with a fuse-cord, are bored in the coal starting from one of the subsidiary galleries. Each of the drill-holes extends the full effective length of the coal face and is loaded with such an explosive charge, and then filled with water under pressure. The charges are exploded in succession, starting with the drill-hole adjacent the coal-face, whereupon the coal so acquired is loaded and removed by the continuous conveyor. The conveyor is operative at all points along the coal-face simultaneously, and is a worm conveyor with a worm associated with a channel open along its length to the coal-face.

2 Claims, 4 Drawing Figures

1
2
3
4
5
6
7
8
9
10
11
12
13
15
16
17
18
19
a
B

COAL EXTRACTION IN A LONGWALL WORKING

BACKGROUND OF THE INVENTION

The invention relates to a method of extracting coal in a longwall working in which the coal is obtained at the longwall face, is loaded and is removed with the aid of a continuous conveyor, acting as a longwall-heading or face conveyor, into one of two subsidiary galleries. In addition, the invention relates to worm conveyor to carry out such a method.

Such methods of extracting coal are applicable to level and to inclined stratifications, because in such stratification conditions gravity is not adequate to remove the coal and hence the heading conveyor has to be employed as a continuous conveyor. A continuous conveyor is required for the continuous removal of the coal because it is only by such means that it is possible to achieve a narrow space which accommodates the conveyor and enables securing of the roof. The length of the longwall face extending between the two subsidiary galleries is basically optional; it may run to several hundred meters, but if residual pillars are left, upon the pulling-in of a spur of coal, for instance for the driving forward of heading packs, and in other special cases it can become reduced to substantially smaller lengths. Subsidiary galleries are therefore also typified by subsidiary spaces involved at the end of the longwall and, for example, ventilated by air outlets.

The extraction methods indicated in the foregoing are in themselves already known. The coal is obtained, loaded and removed principally by mechanical means. Mechanical coal extraction proceeds by machine, mostly with a slicing or cutting action and hence with an essentially point-by-point attack on the longwall face, bearing in mind its length. However with the cutting type of extraction, the extraction machine as a rule also performs the loading work. With the slicing type of extraction an additional loading operation is required, mostly with the aid of a further machine. By way of face conveyors, chain scraper conveyors are almost exclusively employed because the bottom-channel run of such conveyors is sufficiently resistant and can therefore be utilized as a track for the machines employed in the longwall heading.

The essentially point-by-point attack along the longwall face is unfavourable because the extraction rate is dependent solely on the width of the extraction machine, which determines the depth of penetration into the body of coal, and on the speed of advance of the machine. Therefore increase in the extraction rate demands correspondingly increased installed performance of the extraction machine. The power demand of chain scraper conveyors is also unusually high because such conveyors are energy-wise unfavourable due to friction between the chain belt and the channels.

At the basis of the invention is the object of extending the extraction, loading and removal of the debris in the heading to the entire longwall face and, in so doing, to make the chain scraper conveyor superfluous as a track for an extraction machine.

SUMMARY OF THE INVENTION

According to the invention, the foregoing object is achieved through a technique whereby, to extract the coal from one of two subsidiary galleries, long drill-holes are bored in the coal at a spacing from the longwall face corresponding to the effective force of an explosive charge provided with fuse-cord, are loaded with the charge, are acted upon by water under pressure and are fired, whereupon the coal acquired from the explosion is loaded and removed at all points along the longwall simultaneously and continuously by the use of a worm conveyor with a worm-associated channel open to the coal-face.

Among factors at the basis of the invention is a recognition that the lengths hitherto attained by long drill-holes can be increased considerably while still ensuring a specific effective force. As practical tests have shown, with already known drilling equipment it is possible to produce long drill-holes with a uniform burden and extending over lengths of 50 meters and more. According to the length of the longwall and in accordance with one embodiment of the invention, the long drill-holes are bored until they penetrate to the second subsidiary gallery or are driven until they penetrate to a region in the heading advanced into the body of coal; in the latter case, the drill-hole concerned is continued by a further drill-hole started at the advanced region, so as to be able to extract the entire longwall face.

These long drill-holes can be closed off at each end by a water infusing probe and so acted on by the water pressure. On the one hand, through this the suppression of dust is facilitated, and on the other hand the effect of the charge is improved because of the incompressibility of water. This explosive charge comprises the explosive contained in the core of the fuse-cord, the explosive being initiated by an exploder arranged at one end of the fuse-cord. Additionally the fuse-cord for its part may initiate charges contained in several cartridges that are fastened at spaced intervals along the fuse-cord. Such an explosive charge can be drawn inward upon the withdrawal of the drill-rod against the direction of attack of the long drill-hole.

The gathering of the extracted coal takes place on the one hand by means of the laterally open channel of the worm conveyor into which the coal, according to one embodiment of the invention, is impelled by the explosion. The channel in this case is moved forward towards the coal. In another embodiment of the invention, to secure the roof the explosive charge and/or its effective force are so calculated that the coal is loosened and by means of its residual connections supports the area of the yield until the coal is removed. In all cases the flanks of the conveyor worm are also pressed into the coal. The result of this is that the loading and removal of the shattered coal takes place simultaneously along the entire length of the longwall. Through this it is possible to make do with a very narrow conveying area and to keep the space of the heading which is opened up during extraction and is initially not extended so small that it is possible fully to secure the roof.

The invention possesses the advantage of an extraction system that at all points along the heading and at every instant copes with all the work required. The method according to the invention also possesses adequate flexibility as regards different seams, i.e. it can according to the occasion adapt to different stratification circumstances. In addition, the method according to the invention requires a relatively small work force and furthermore possesses the advantage that the power outputs of the machines to be installed are overall considerably reduced. At the same time, the rates of extraction attained and the utilisation-index of the longwall equipment are very high.

Steel worms to pick up and load debris on to a conveyor belt disposed to the rear are already known in loading machines. In addition, an extraction method is known in which, by means of a steel worm, drilled-out material is removed that is acquired by a bit located on the tip of a drill-rod forming the worm shaft. Worm-associated channels are not, however, provided here, so that already known worm conveyors are not regarded as conveying equipment for use along the longwall heading.

The extraction to plan of coal by longwall working with the assistance of shot-firing is admittedly also already known. But because of unsolved loading and transporting problems, the application of this method of extraction has been restricted to cases of steeply tilted stratification or, with level and sloping stratification, shot-work has been limited to the extraction of short fractional lengths along the longwall face. Thus, it is, for example, a known technique to extract, through blasting by means of long drill-holes, the coal to be found in the so-called machine "stables" which have to be driven for the chain scraper conveyor and the extraction machine. Insofar as long drill-holes have otherwise been employed to extract coal in a level stratification, here what applies is pillar work, in which short lengths of the working face are present and the transport and extension problem plays no part ("Nobel-Heft" January 1973, 26, 32).

Other objects and features of the present invention will appear more fully below from the following detailed description considered in connection with the accompanying drawings, which disclose preferred embodiments of the invention. It is to be expressly understood, however, that the drawings are designed for purposes of illustration only and not as a definition of the limits of the invention, reference for the latter purpose being had to the appended claims.

DESCRIPTION OF THE PREFERRED EMBODIMENTS

Figure 2:
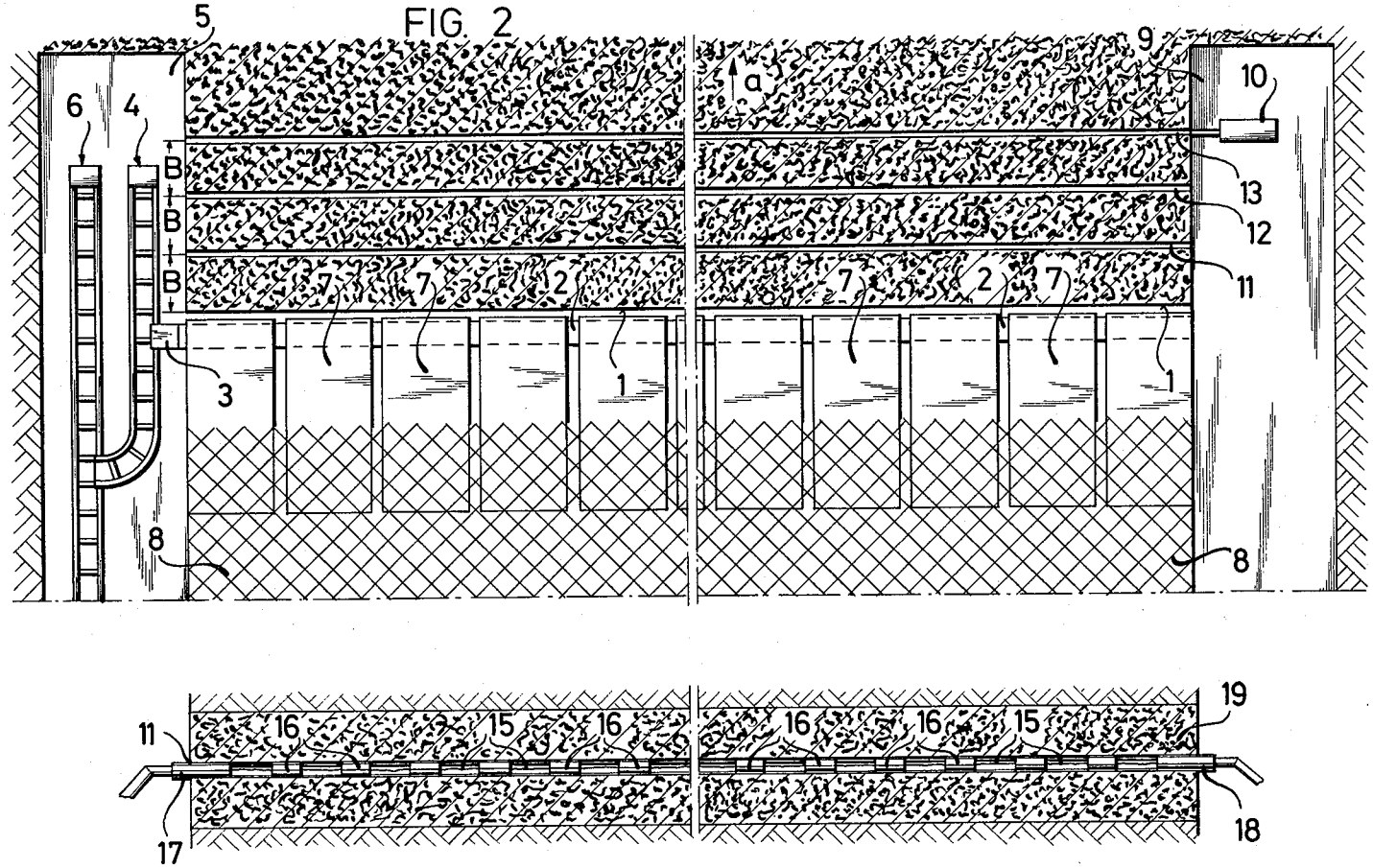
FIG. 2 shows a third embodiment in accordance with the invention in a presentation corresponding to that of FIG. 1, but with further details shown.

FIG. 2 is a top view with an interrupted presentation of a longwall heading with level stratification. The longwall face is denoted by 1 and is worked in the direction of the arrow a. For removing the coal, a continuous face conveyor 2 is used which by means of a chute 3 provides transport out to a loading conveyor 4 which is laid along a subsidiary gallery 5. The loading conveyor 4 passes the coal extracted in the heading to a roadway conveyor 6.

The heading is enlarged by extension plates 7 and is worked by packing the goaf with fragmented debris, the "old ground" being shown at 8.

From a second subsidiary gallery 9, with the aid of a drilling machine 10, long drill-holes 11, 12 and 13 are bored till they penetrate into the subsidiary gallery 5. The spacing of the long drill-holes 11 to 13 from each other or from the longwall face 1 corresponds to the burden, and is shown at B in the upper part of FIG. 2.

The lower part of FIG. 2 is a longitudinal section taken through the long drill-hole 11. According to this presentation, the explosive charge with which the drill-hole is loaded consists of fuse-cord 15 and a string of explosive cartridges 16 which are fastened at equal intervals along the fuse-cord 15. This explosive charge and the drill-hole is subjected to water pressure with the aid of two water infusing probes, 17 and 18 respectively, which are fastened into the ends of the long drill-hole 11.

In the embodiment illustrated in this figure, each burden is dealt with by a single long drill-hole, 11 or 12 or 13. Dependent on the thickness of the seam, however, several long drill-holes can also be made for each burden, distributed across the thickness of the seam 19. In the embodiment shown the long drill-holes 11, 12 and 13 are disposed of, by exploding the charges, in succession. The coal extracted during this procedure is loaded and removed by a worm conveyor, which constitutes the longwall-heading or face conveyor 2.

Figure 3:
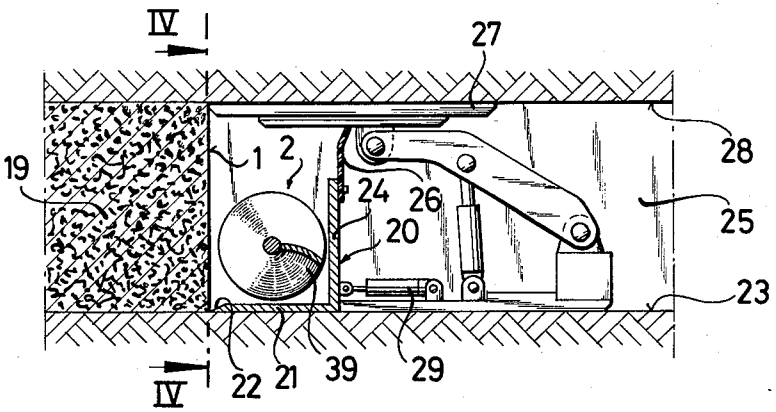
FIG. 3 is a section on the line III—III in FIG. 4.

The worm conveyor 2 has a channel which, as shown in FIG. 3, consists of an angle-unit 20. The angle-unit has a lower plate 21 which, facing the coal-body, is provided with a cutting edge 22 so as, when so required, to slice away coal left behind on the floor 23 when the channel 20 is shifted. In addition, the channel 20 has a plate 24 running substantially at a right angle to the plate 21 and intended to give protection against the catapulting of fragmented debris into the area shown at 25 in FIG. 3. This plate can be made to match the thickness of the seam at any time by means of a flexible upper strip 26 of, for example, rubber or plastic.

Work to extend the longwall-heading gives support to the roof 28, after its exposure by the completed explosion, by means of the roofing plates 27. The roofing plates 27 or the cap units of a step-by-step roof-supporting device can be made to match the burden and are therefore longer than the usual cap units.

The channel 20 is moved forward with the aid of advancing cylinders 29. As the amount of explosive or the burden can be chosen in such a way that either the coal is only loosened, i.e. still with its connections supports the roof, or is flung on to the conveyor 2, the worm conveyor performs loading and conveying work at all points along the heading simultaneously to dispose of the loosened heap.

Figure 4:
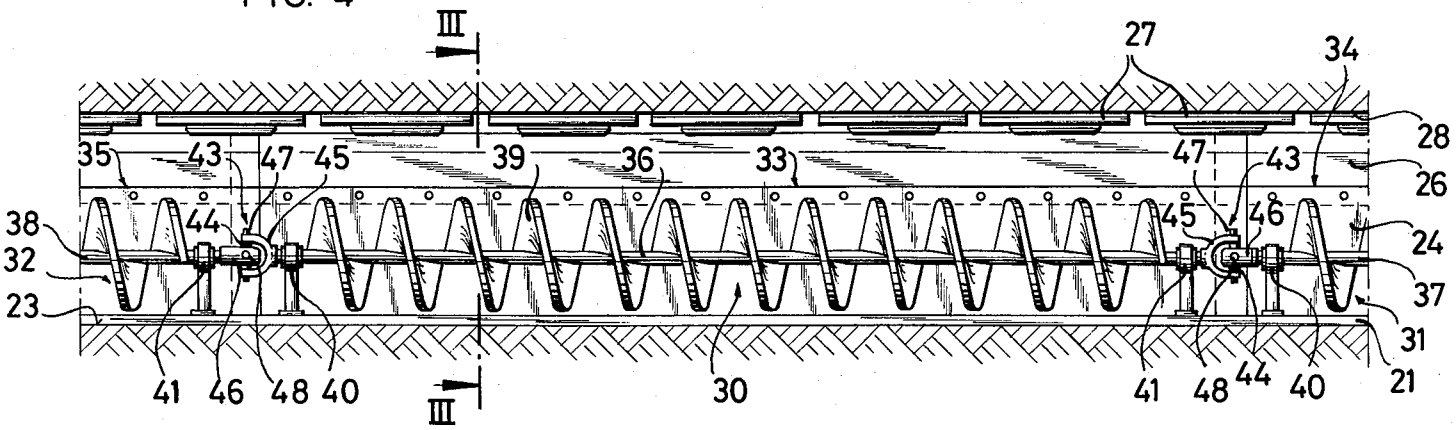
FIG. 4 is a section on the line IV—IV in FIG. 3.

The worm conveyor 2 consists of sectional lengths, which in FIG. 4 are denoted generally by 30 to 32. Each sectional length consists of a channel length 33, 34 or 35 and a corresponding length of worm shaftings 36, 37 or 38. On the worm shafting there is a complete steel helix 39. Each length of worm shafting 36 possesses, according to the embodiment shown, two bearings 40 and 41. Adjacent to the bearings universal joints 43 are fixed to the lengths of shafting. The universal joints couple the worm shaftings 36 to 38 in such a way that the individual lengths 33 to 35 can be angled with respect to each other in both horizontal and vertical planes.

Each universal joint 43 has a central ring 44 and two forks, 45 and 46 respectively, which in each instance are attached to the ends of the associated universally-jointed shaftings 36 and 37 or 38. The ring 44 is connected to the forks 45, 46 by pivot pins 47 and 48, the axes of which intersect at right angles in the well-known manner of a Hooke's joint.

The bearing pedestals 40 and 41 and also the universal joints 43 are of such dimensions that they constitute only trivial obstacles to the flow of coal produced along the channel 20 by the worm conveyor. The drive means for the worm conveyor is housed conventionally in the longwall-heading or in the gallery and is not shown in the drawings.

Figure 1:
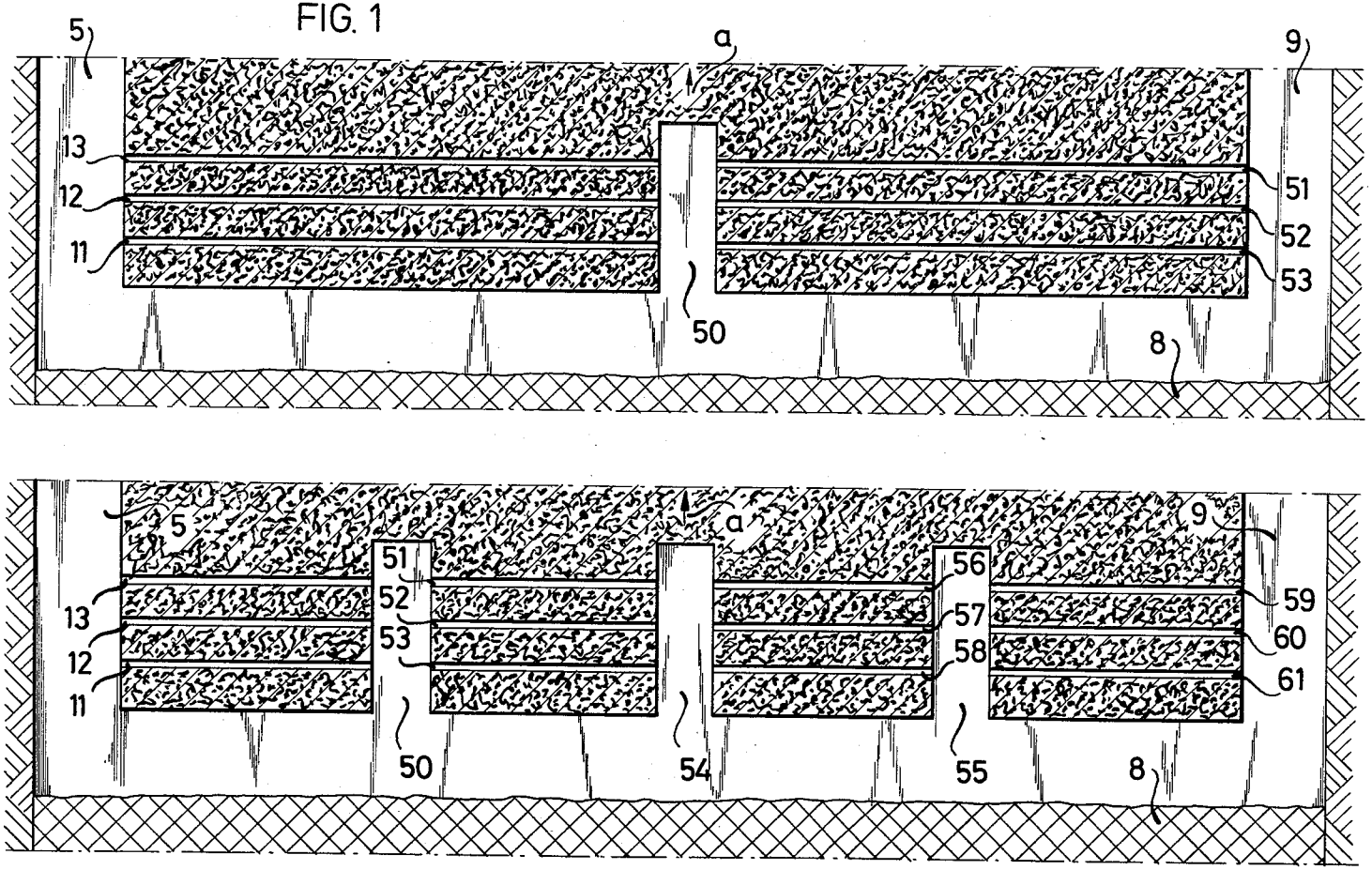
FIG. 1 shows two embodiments of the method of the invention by means of top views of a longwall heading.

FIG. 1 shows a longwall-heading with the longwall working equipment omitted. As the direction of the subsidiary galleries 9 and 5 indicate, in both cases shown in this figure extraction proceeds by the retreating system in the direction of the arrow a.

According to the upper presentation in FIG. 1, the long drill-holes 11 to 13 are driven as far as a region 50 included in the heading. The region 50 is merely driven into the coal. Each drill-hole is continued by means of drill-holes 51 to 53, which are started at the region 50 or in the gallery 9 and are accordingly driven forward to the region 50 or to the gallery 9, as the case may be. The explosive charges are drawn into the respective drill-holes when the drill-rod is withdrawn.

In the lower embodiment of FIG. 1, the long drill-holes are continued by long drill-holes which reach up to a further region 54, advanced into the coal-body. These long drill-holes 51 to 53 are continued by means of further long drill-holes 56 to 58, which reach up to a region 55. Continuations are provided by means of long drill-holes 59 to 61, which penetrate as far as the gallery 9.

The burdens are broken away individually by firing of the respective long drill-holes. It is preferable that the next burden should be broken away after the removal of the heap. However, one can also break away several burdens in succession and only then undertake removal action.

I claim:

1. A method of longwall coal mining comprising the following steps:

a. exposing a longwall coal face in a coal seam between a roof of upper strata and a floor of lower strata, b. providing at substantially right angles to the coal face two galleries spaced laterally from each other, c. providing a screw conveyor having an associated channel coextensive with the coal face, the channel being open along one side to permit introduction of coal into said screw conveyor and being defined by floor plate means, roofing plate means, and a rear wall plate means extending between and interconnecting said floor and roofing plate means, d. positioning the channel of said screw conveyor adjacent and in slightly spaced relation to the coal face with the floor plate means on the lower strata and the roofing plate means in supporting contact with the upper strata, and with the axis of said screw conveyor parallel to the coal face, the channel being open towards the coal face, e. adjusting the height of said rear wall plate means to extend between said floor plate means and said roofing plate means, whereby the channel and the coal face cooperate to surround said screw conveyor, f. drilling a plurality of long holes extending from one gallery to the other and spaced from the longwall face and from each other a predetermined distance, g. loading each hole with explosive charge, h. firing the charges to extract the coal so that the coal face is cut off by an amount corresponding in length to the length of such face and in height corresponding to the height of the coal seam and in depth corresponding to the predetermined effectiveness of the charge, whereby the extracted coal is loaded into the channel associated with said conveyor, and i. removing extracted coal at all points along the longwall face simultaneously by said screw conveyor.

2. A method of longwall coal mining as claimed in claim 1, comprising a. firing the explosive charges in the separate drill holes successively starting with the drill hole adjacent the longwall face, b. employing as explosive charges for each drill hole a series of spaced cartridges connected together by a fuse cord, and c. closing off the ends of each drill hole by a water infusing probe for not only improving the effectiveness of the explosive charge, but also facilitate the suppression of dust.

* * * * *